US006925954B1

(12) United States Patent
Van Acker, Jr. et al.

(10) Patent No.: US 6,925,954 B1
(45) Date of Patent: Aug. 9, 2005

(54) SYSTEMS AND METHODS FOR ALLOWING UNDERWATER ESCAPE FROM A SUBMARINE

(76) Inventors: Henry Van Acker, Jr., 58 State St., #7, Rouse's Point, NY (US) 12979; Charles A. Bollfrass, 17802 Forest Park La., Spring, TX (US) 77379-9729

( * ) Notice: Subject to any disclaimer, the term of this patent is extended or adjusted under 35 U.S.C. 154(b) by 38 days.

(21) Appl. No.: 10/785,145

(22) Filed: Feb. 24, 2004

(51) Int. Cl.[7] ..... B63G 8/41
(52) U.S. Cl. ..... 114/323
(58) Field of Search ..... 114/323, 324, 322

(56) References Cited

U.S. PATENT DOCUMENTS 1,822,435 A * 9/1931 Gioachino ..... 405/189
2,077,477 A * 4/1937 Hellman ..... 114/323
3,987,742 A 10/1976 Boisrayon et al. ..... 114/335

FOREIGN PATENT DOCUMENTS

RU 2149123 5/2000

* cited by examiner

*Primary Examiner*—Jesus D. Sotelo
(74) *Attorney, Agent, or Firm*—Heslin Rothenberg Farley & Mesiti P.C.; Victor A. Cardona, Esq.

(57) ABSTRACT

A method for allowing underwater escape from a submarine includes attaching a lower escape tower connector of an escape tower to a hatch connector of a submerged submarine to sealingly attach a lower end of the escape tower to the submarine. A first riser tube is attached to an upper escape tower connector of the escape tower and second riser tube is attached to the first riser tube to form an escape tunnel. Water is replaced in an interior of the escape tower and a tunnel interior of the escape tunnel by air. An exterior hatch of the submarine is opened and a person passes through the hatch. The person is raised to the water surface through the tunnel.

34 Claims, 6 Drawing Sheets

SYSTEMS AND METHODS FOR ALLOWING UNDERWATER ESCAPE FROM A SUBMARINE

TECHNICAL FIELD

This invention relates, in general, to submarine rescue and, in particular, to systems and methods for allowing underwater escape from a submarine.

BACKGROUND ART

The sinking of the Russian submarine, Kursk, in August 2000 attracted worldwide attention particularly when it became apparent that crew members may have been alive inside the submarine but were trapped in a rear compartment and could not be rescued. This was despite the vessel being at 108 meters, which is approximately within the maximum, human wet-diving depth of 100 meters.

The U.S. Navy has Deep Submergence Rescue Vehicles (DSRV), which may mate with submarine hatches to allow 5 or 6 crewmembers at a time to be removed from a submarine therein. However it is not known how many of these DSRV's exist or if they are positioned to allow them to be transported promptly to the location of a disabled submarine.

U.S. Navy submarines typically have three hatches, specifically one fore, one in the conning tower and one aft. The aft hatch is configured to attach an external vessel that Navy Seals may use for ingress or egress. The forward hatch contains the primary submarine escape vessel, a vertical tower, wherein individuals may enter and close the primary hatch, don a Stenke escape hood, flood with sea water, open the outer hatch, and "blow" their way to the surface when at 100 meters of depth or less.

Off-shore petroleum wells are developed at depths far exceeding the 108 meters at which the crewmembers of the Kursk perished. Further, drill ships for drilling undersea wells are positioned at various locations around the world.

Thus, a need exists for systems and methods for allowing underwater rescue of crew members from a disabled submarine which allows a rescue of the crew members within an acceptable time frame and at various depths.

SUMMARY OF THE INVENTION

The present invention provides, in a first aspect, a system for allowing underwater escape from a submarine which includes a plurality of walls forming an interior portion configured to receive at least one person, which are configured to resist collapse due to a pressure of external water. A lower escape tower connector is located at a bottom end of the plurality of walls and is configured to sealingly attach to a hatch connector of a submerged submarine. Also included are means for selectively maintaining the interior substantially free of water and a hatch formed in the plurality of walls, which is selectively openable to allow a person to pass therethrough.

The present invention provides, in a second aspect, a method for allowing underwater escape from a submarine which includes attaching a lower escape tower connector of an escape tower to a hatch connector of a submerged submarine to sealingly attach a lower end of the escape tower to the submarine. Water is replaced in the interior of the escape tower with air, and an exterior hatch of the submarine is opened and a person is passed through the hatch into the interior. The method further includes discharging air from the interior of the escape tower and opening a hatch of the escape tower. An escape hood is utilized to ascend to a water surface.

The present invention provides, in a third aspect, a method for allowing underwater escape from a submarine which includes attaching a lower escape tower connector of an escape tower to a hatch connector of a submerged submarine to sealingly attach a lower end of the escape tower to the submarine. A first riser tube is attached to an upper escape tower connector of the escape tower and an escape tunnel is formed by attaching the second riser tube to the first riser tube. The method further includes replacing water in an interior of the escape tower and the escape tunnel with air. An exterior hatch of the submarine is opened and a person passes through the hatch. The person is raised to the water surface through the tunnel.

The present invention provides, in a fourth aspect, a method for allowing underwater escape from a submarine which includes attaching a hatch assembly to the exterior of the submarine, when the submarine is submerged, and attaching an escape tower to a connector of the hatch assembly. The escape tunnel is attached to the escape tower and the hatch assembly is sealed relative to the exterior of the submarine. A drilling guide is attached to the escape tower and a hole is drilled in a wall of the submarine through the drilling guide.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be apparent from the following detailed description of preferred embodiments taken in conjunction with the accompanying drawings in which:

DETAILED DESCRIPTION

In accordance with the principles of the present invention, systems and methods for allowing underwater escape from a submarine are provided.

Figure 1:
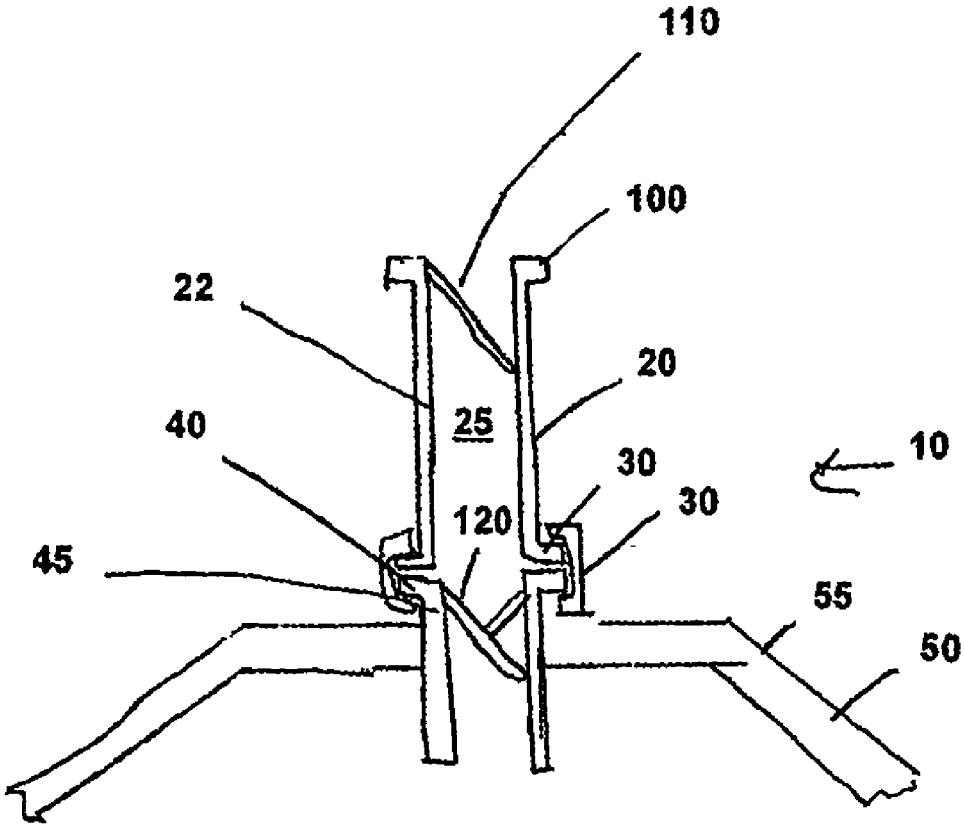
FIG. 1 is a side cross-sectional view of a system for allowing escape from a submarine, including an escape tower connected to a hatch box connector of a submarine.

In an exemplary embodiment depicted in FIG. 1, a system 10 for allowing underwater escape from a submarine includes an escape tower 20 having a lower escape tower connector 30 configured to sealingly attach to a submarine escape hatch box connector 40 of a hatch assembly 45 of a submerged submarine 50.

Escape tower 20 may be a vertical pressure vessel with upper and lower connectors (e.g., lower escape tower connector 30), which is made of 140 ksi yield strength, HSLA steel, which may be pressure rated for burst or collapse to 3048 meters (10,000 feet) of sea water. Further, escape tower 20 may be plumbed with redundant, internal and external valves and openings to displace fluids between an interior 25 of escape tower 20 and an exterior thereof. Escape tower 20 may be constructed substantially identically to the standard escape chamber below the forward hatch of U.S. Navy submarines. However, as is evident from FIG. 1, tower 20 is connected externally to a submarine utilizing lower escape tower connector 30 to allow connection thereof to hatch connector 40 which may be located at any of the hatches of a submarine. Further, walls 22 of tower 20 are pressure rated as noted above to prevent collapse thereof by water that is excluded from interior 25. Tower 20 is connected to hatch connector 40 on an exterior wall 55 of submarine 50.

Walls 22 of escape tower 20 may bound interior 25 configured to receive a person and allow the person to pass therethrough. Also, escape tower 20 may include an upper hatch 110 and a lower hatch 120 configured to open and to maintain air in interior 25, and to inhibit surrounding water from entering interior 25 when closed. For example, hatch connector 40 may include a protruding portion (not shown) which is engageable with lower escape tower connector 30 in a manner similar to the connection of a submerged wellhead to a primary riser tube or riser configured to connect to such a submerged wellhead (e.g., sub-sea wellhead), as is known in the petroleum drilling art. Also, lower escape tower connector 30 may be formed as a connector configured to sealingly connect such a drilling riser tube to such a submerged wellhead connector, e.g., hatch connector 40. Further, hatch connector 40 may be a connector as exists on hatch assemblies of current U.S. Navy submarines which are configured to mate with DSRV's and lower escape tower connector 30 may be formed as are connectors on existing DSRV's configured to mate with hatch assemblies on current U.S. Navy submarines. Also, interior 25 may be dimensioned to allow internal opening (i.e., toward interior 25) of upper hatch 110 and/or lower hatch 120. By allowing the internal opening of such hatches, any unknown external blockage would not prevent an opening of the hatch. Instead, the hatch may be opened internally and the blockage may be moved away from the hatch opening by a person located on an interior side of the opening. A hatch which opens toward an interior of a sub or hatch, i.e., away from a pressure source, may utilize an integral indicator (e.g., a pressure gauge) to determine if external pressure exists, so that inadvertent opening of such a hatch subject to external fluid pressure can be avoided. Alternatively, the hatch (e.g., hatch 120 or hatch 110) could open externally which would allow the external pressure (i.e., of the water) to provide a natural sealing force when the hatch is in a closed position.

Escape tower 20 may be lowered from water's surface, for example, using a drill string (not shown), and attached to submarine 50 as described above. The drill string, as used in the petroleum drilling art, may be an operational pipe-arm, used vertically (i.e., relative to a gravitational force downwardly), to raise, lower and manipulate tools in deep water. Such tools may operate at various angles relative to the drill string. A typical drill string pipe is 5½" outer diameter (OD)×4½" inner diameter (ID), with 7¼" OD connectors made of 140 ksi yield strength, HSLA steel. Maximum use depth of such a drill string is about 6000 meters (19,686 feet).

Attachment of tower 20 to submarine 50 may utilize such a drill string extended from a dynamically positioned vessel, e.g., a drill ship. The tender, i.e. ship, would require a crane with a winch, e.g., a derrick with draw works, mounted over a vertical operational opening (e.g., a moon pool) through the ship, through which the drill string would attach to an upper escape tower connector (UETC) 100 to allow the drill string to "trip" and manipulate tower 20. Once at depth, escape tower 20 may be joined to hatch connector 40 by the drill string with the aid of lights and video camera(s) lowered around the drill string, as is commonly done in petroleum drilling when connecting drilling riser tubes and submerged wellheads.

The production of petroleum in water beyond the continental shelf requires that both drilling and production be conducted from floating platforms, requiring equipment which allows for cyclic, alternating reversed horizontal positioning of the vessel and its suspended equipment (e.g., drill string and/or tools coupled thereto) with respect to the sea floor, or a sunken submarine in order to compensate for the routine, continuous effect of sea currents and local sea states. Recoverable beacons may be dropped to a seabed at the site as reference points from which to dynamically position the vessel against the local sea state to maintain location of the platform or ship over the well head being drilled. The maintenance of drill ships in a relative stationary location may also be performed in the vicinity of a submerged submarine in the same manner.

The draw works attachment to the drill string would require active heave control to virtually eliminate drill string heave transmitted by the surface vessel to suspended equipment (e.g., drill string and/or tools coupled thereto with respect to the vessel). In order to compensate for the vertical heave of the platform and its effect on the drill string, or on a larger diameter riser tube tube, which may be the primary return conduit from the sea floor to the surface and within which the drill string may operate. Vertical vessel heave occurs due to natural sea states, and also due to attendant vessel pitch or roll. Thus, petroleum drill ships or floating platforms possess the means to compensate for vessel heave when lowering and emplacing intervention tools (e.g., the drill string and/or other tools). Such heave compensators may respond to the pitching and/or rolling of the sea by hydraulic or other means to counteract the vertical vessel heave to allow the drill string and/or other tools to remain in a relatively constant position to allow them to perform their intended function.

Hydraulic control valves in the drill string would be shifted to latch or unlatch, and lock or unlock the lower escape tower connector 30, e.g., a collet-type lower connector, located at the bottom of tower 20 to connect lower escape tower connector 30 to hatch connector 40. The drill string would then be retrieved, detaching at Upper Escape Tower Connector (UETC) 100. Each riser or riser tube 205 may include a hydraulic line connectable to hydraulic lines in each other riser tube 205 or to a line extended from a hydraulic pressurization regulator on a drill ship such that the latching or unlatching may be controlled via the pressurizing or un-pressurizing of such hydraulic lines. Also, a separate system (e.g., separate hydraulic lines) may hydraulically lock and/or unlock such connections between the components to be connected (e.g., riser tubes 205, tower 20, hatch assembly 45). Such separate latching and locking systems may prevent accidental unlocking of a connection which could result in infiltration of water into an evacuated riser tube 205 or tower 20, for example.

As described above, the maximum, human wet-diving depth limit is about 100 meters below sea water's surface. Water pressure at 100 meters is about 142 LBS/sq-in (10 kg/sq-cm); and at 108 meters it is about 153 LBS/sq-in. Thus, at depths of up to about 100 meters, tower 20 may be attached to submarine hatch connector 40 as described, and individuals may enter interior 25 from disabled submarine 50, close lower hatch 120, don an escape hood (e.g., a Stenke escape hood), flood interior 25 with sea water, open outer hatch 110, and ascend by "blowing" their way to the surface, as will be understood by those skilled in the submarine art. Any power required to remove water from, and/or to flood, interior 25 may be supplied by the drill string via hydraulic or other means. Such water may be removed from interior 25 by pressurized air supplied by the drill string, for example. As noted above, the forward hatch of current U.S. Navy submarines includes a vertical tower similar to escape tower 20. Therefore, tower 20 would likely only be attached to submarine 50 at this depth for the purpose of allowing crew members to "blow" their way to the surface, when the vertical tower typically present in U.S. Navy submarines is inoperable.

Figure 2:
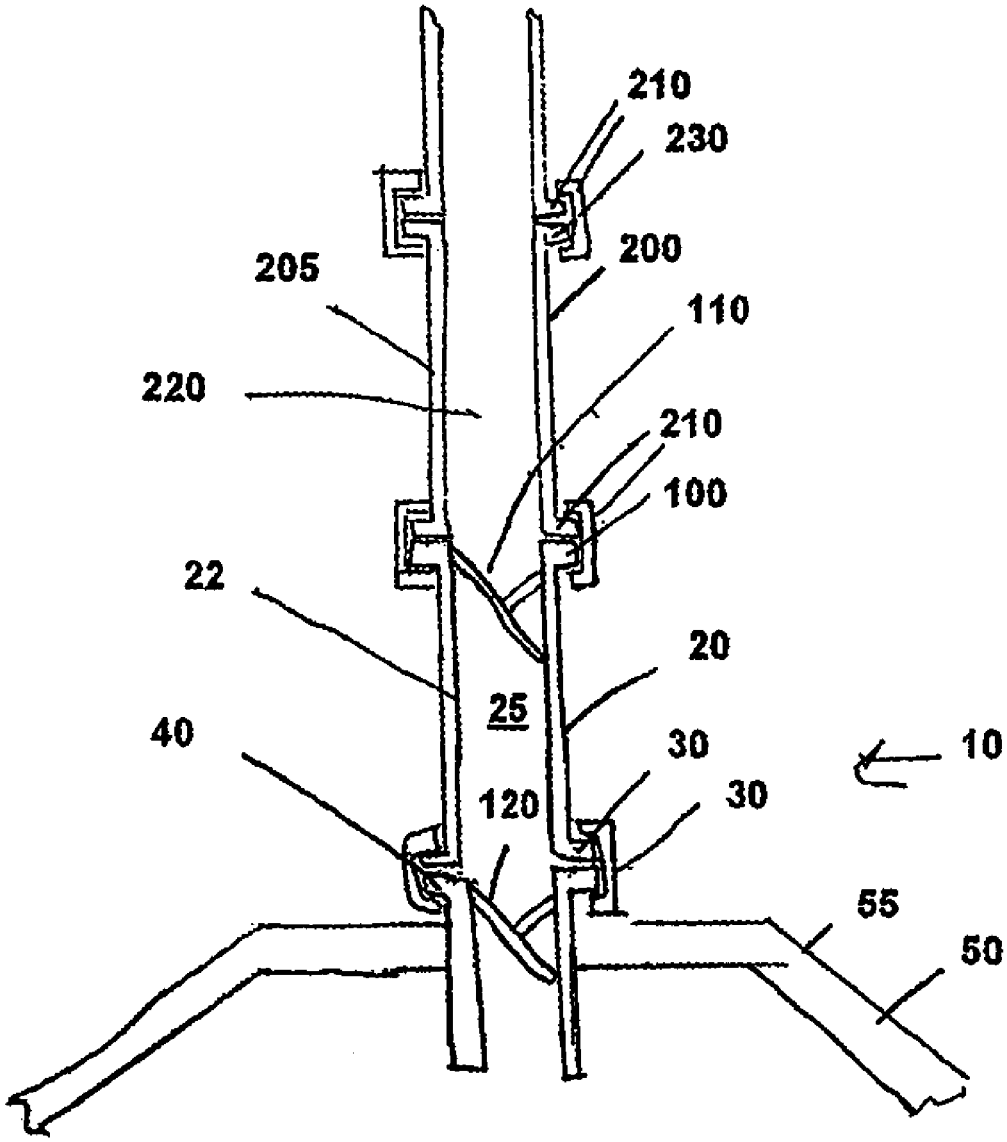
FIG. 2 is a side cross-sectional view of the system of FIG. 1 further including a plurality of riser tubes connected to the escape tower.

In a second embodiment of the invention depicted in FIG. 2, escape tower 20 may be connected to submarine 50, as noted above, and a top side thereof may further be attached to an escape tunnel 200 which may include one or more riser tubes 205, e.g. petroleum drilling riser tubes. The bottom end of escape tunnel 200 may include a lower tunnel connector 210, which may be identical to lower escape tower connector 30, and which may sealingly connect escape tunnel 200 to upper escape tower connector 100. Upper escape tower connector 100 may be identical to hatch connector 40. Accordingly, when connected to each other, a seal between lower tunnel connector 210 and upper escape tower connector 100 may maintain water outside a tunnel interior 220 of escape tunnel 200 and interior 25, when water has been evacuated from tunnel 200 and interior 25. Riser tubes 205 may be connected to one another via upper tunnel connectors 230 and lower tunnel connectors 210, which may be identical to lower escape tower connectors 30 and upper escape tower connectors 100, respectively, to form escape tunnel 200 of a desired length.

Escape tunnel 200 may be utilized if a submarine is disabled at a depth too deep for wet-diving, i.e. greater than about 100 meters. In particular, a drill string may be detached from upper escape tower connector (UETC) 100 and retrieved after the attachment of escape tower 30 to hatch connector 40 of submarine 50 as described above. Riser tube 205 may then be lowered to be affixed or "landed" to upper escape tower connector 100 by the drill string, as described for escape tower 20. An active heave compensator may be activated to eliminate vertical vessel heave from the drill string and escape tower 20, to effect a "soft" landing of riser tube 205 to escape tower 20. Remotely Operated Vehicles (ROV's), e.g., submersible robots that are remotely controlled and operate with a tether from a suspended module lowered by cables thereby allowing operation without internal personal, may be available to guide and support these activities. Compressed air (e.g., 300 psi for 693 meters or 4335 psi for 3048 meters) may be supplied to escape tunnel 200 by the drill string or ROV to evacuate tunnel 210 comprised of one or more riser tubes 205. Following seawater evacuation, valves may be closed and the compressed air may be vented with escape tunnel 200 being formed to withstand the collapse pressure produced by the sea surrounding vented escape tunnel 200. Drilling riser tubes utilized in the petroleum drilling industry are typically internally pressure rated and are typically 22" OD×20½" ID, with clamp-type, rapid connections, made of 140 ksi yield strength, HSLA steel. Dual hydraulic lines are attached to a typical riser tube and are 3" OD×2¼" ID, for example. Such hydraulic lines may allow latching or unlatching as described above or other remote functions operated by hydraulics. Also, such riser tubes are depth rated at 3048 meters (10,000 feet) with external buoyancy/thermal insulation coatings. One or more riser tubes connected to one another may thus exclude seawater from hatch assembly 45 to a water-air interface thereby providing a tunnel through which a personnel cable may be lowered/raised to allow a person to pass therethrough for escape to a water surface.

Figure 3:
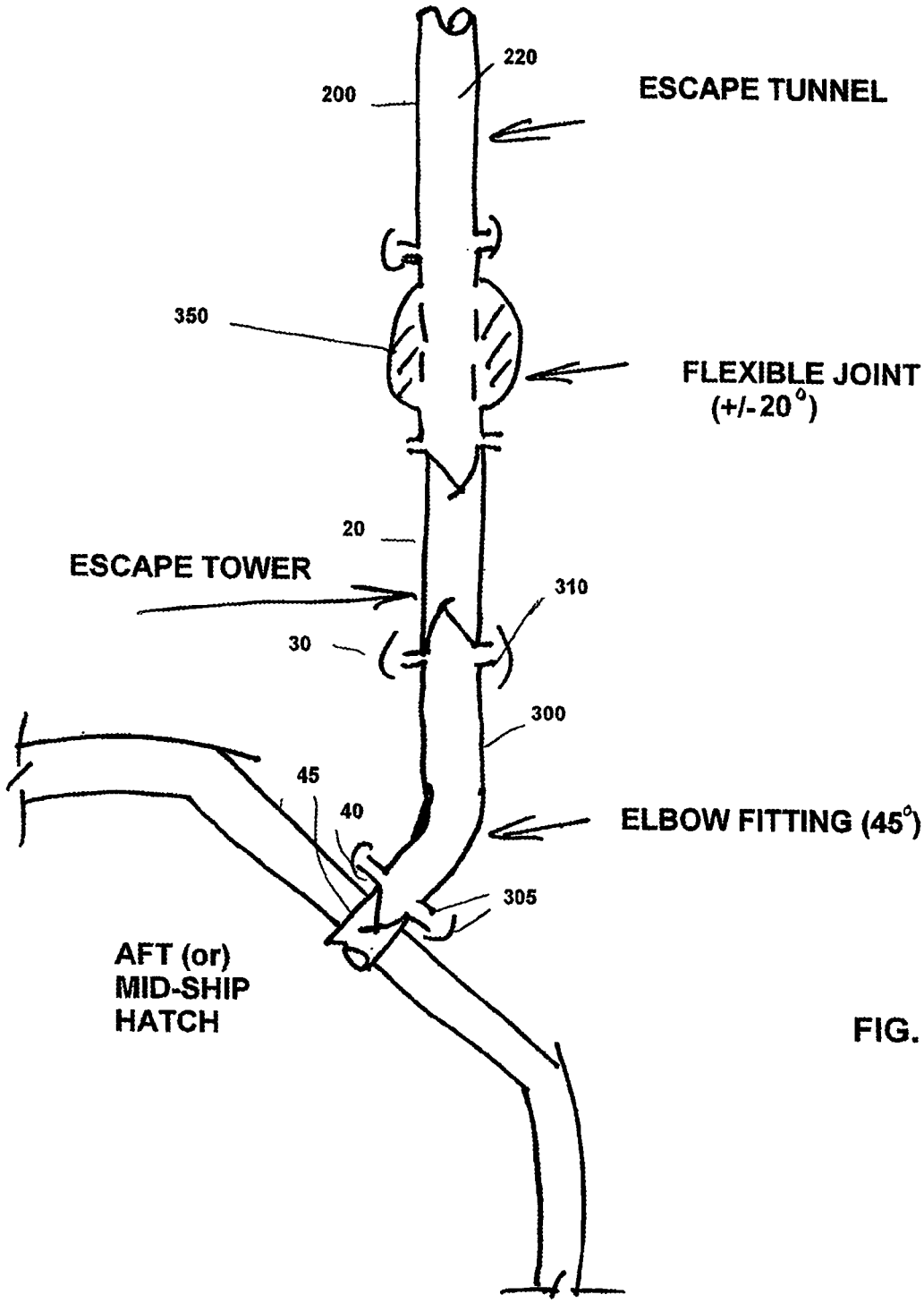
FIG. 3 is a side cross-sectional view of another embodiment of a system allowing escape from submarine which includes an elbow fitting, an escape tower, a flexible joint, and an escape tunnel connected to each other in series.

As will be evident, a disabled submarine may usually be positioned on its bottom, but may also be positioned on its side such that its hatches are not aligned vertically or substantially perpendicular to a water-air interface. Regarding the latter situation, FIG. 3 depicts an elbow fitting 300 which may be made of 140 ksi yield strength, HSLA steel. Elbow fitting 300 may be formed of an angled tubular fitting with a longer vertical leg and having a top elbow connecter 310 on a top end, which may be identical to hatch connector 40 or upper escape tower connector 100, for example. Also, a bottom elbow connector 305 identical to a lower escape tower connector 30 (e.g., a tunnel-pin or pilot-box connector), may be formed on a bottom end of elbow fitting 300. Typical angles of elbow fitting 300 could include 3, 7.5, 15, 30, 45, or 90 degrees (DEG). Due to the uncertainties associated with the positioning of the submarine on the seabed, it would be advantageous to have elbow fittings 300 formed at various of such angles in the event that they were needed in particular submarine intervention situations.

Elbow fitting 300 may be connected to lower escape tower connector (LETC) 30 prior to escape tower 20 being lowered toward submarine 50. Elbow fitting 300 may be approximately sized to compensate for an angle of hatch assembly 45 relative to the vertical. The connection of elbow fitting 300 to hatch connector 40 could be accomplished with the drill string as described above for escape tower 20 alone with bottom angle connector 305 substituting for lower escape tower connector 30.

Figure 6:
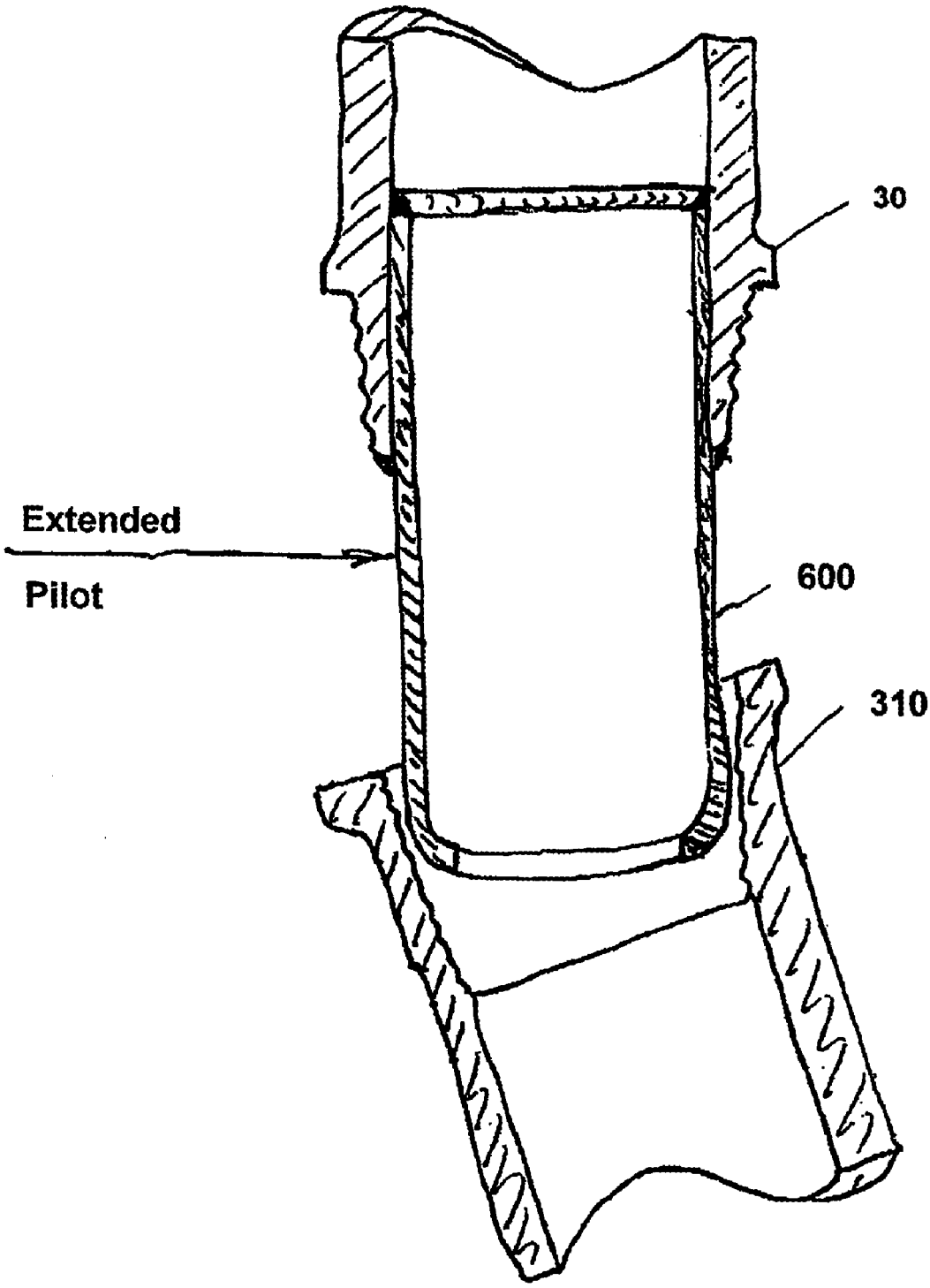
FIG. 6 is a side cross-sectional view of the lower escape tower connector of the tower of FIG. 3 engaging the upper connector of the elbow fitting of FIG. 3 using a tunnel-pin connection.

Alternatively, elbow-fitting 300 may be lowered to hatch connector 40 of submarine 50 and attached thereto and escape tower 20 may be lowered thereafter and attached to elbow fitting 300. Specifically, elbow fitting 300 would be lowered using the drill string and bottom angle connector 305 engaged with a connector of a hatch, e.g., hatch connector 40 of hatch assembly 45, positioned at an angle to the vertical. For example, a short length of pipe may extend from bottom angle connector 305 to act as a pilot to align and direct the two connectors (i.e., bottom angle connector 305 and hatch connector 40) together to form a connection. Also, the vertical leg of the Fitting 300 would be longer to (1) provide a pilot to encourage misaligned engagement and (2) allow for bending due to slight misalignment with the riser tube being lowered. Similarly, tower 20 may be lowered using the drill string and engaged with an upper connector 310. For example, a short length of pipe may extend from lower escape tower connector 30 to act as a pilot to align and direct the two connectors (i.e., lower escape tower connector 30 and upper connector 310 of elbow fitting 300) together to form a connection. As depicted in FIG. 6, a pilot 600, or cylindrical extension with a rounded nose, may be affixed to the inside of the lowered box (e.g., external thread (male)) connector (e.g., lower escape tower connector 30) such that, after initial engagement, the two components are forced into centerline alignment during further lowering, compensating for minor misalignment (e.g., 3–5 degrees from vertical). Such forced alignment during lowering requires adequate length to allow for elastic flexing (i.e., bending) of the lower (e.g., internal thread (female)) connector (e.g., upper connector 310). Greater pilot length allows for greater misalignment, (i.e., the greater length provides more leverage to force alignment of the engaging components As depicted in FIG. 3, a flexible joint 350 may be connected between escape tower 20 and escape tunnel 200. Flexible joint 350 may inhibit or eliminate bending stresses on escape tower 20 or escape tunnel 200 resulting from dynamic positioning of the surface vessel, i.e. movement of the vessel to maintain it in a relatively stationary position. For example, flexible joint 350 may be a standard drilling riser tube tool that allows 20 degree (DEG) movement from the vertical over 360 DEG of revolution, as is known in the art of underwater petroleum drilling. Further, flexible joint 350 may be utilized between two riser tubes 205 of escape tunnel 200, between tower 20 and elbow fitting 300, or between other components for which it is desirable to inhibit undesirable bending stresses.

Figure 4:
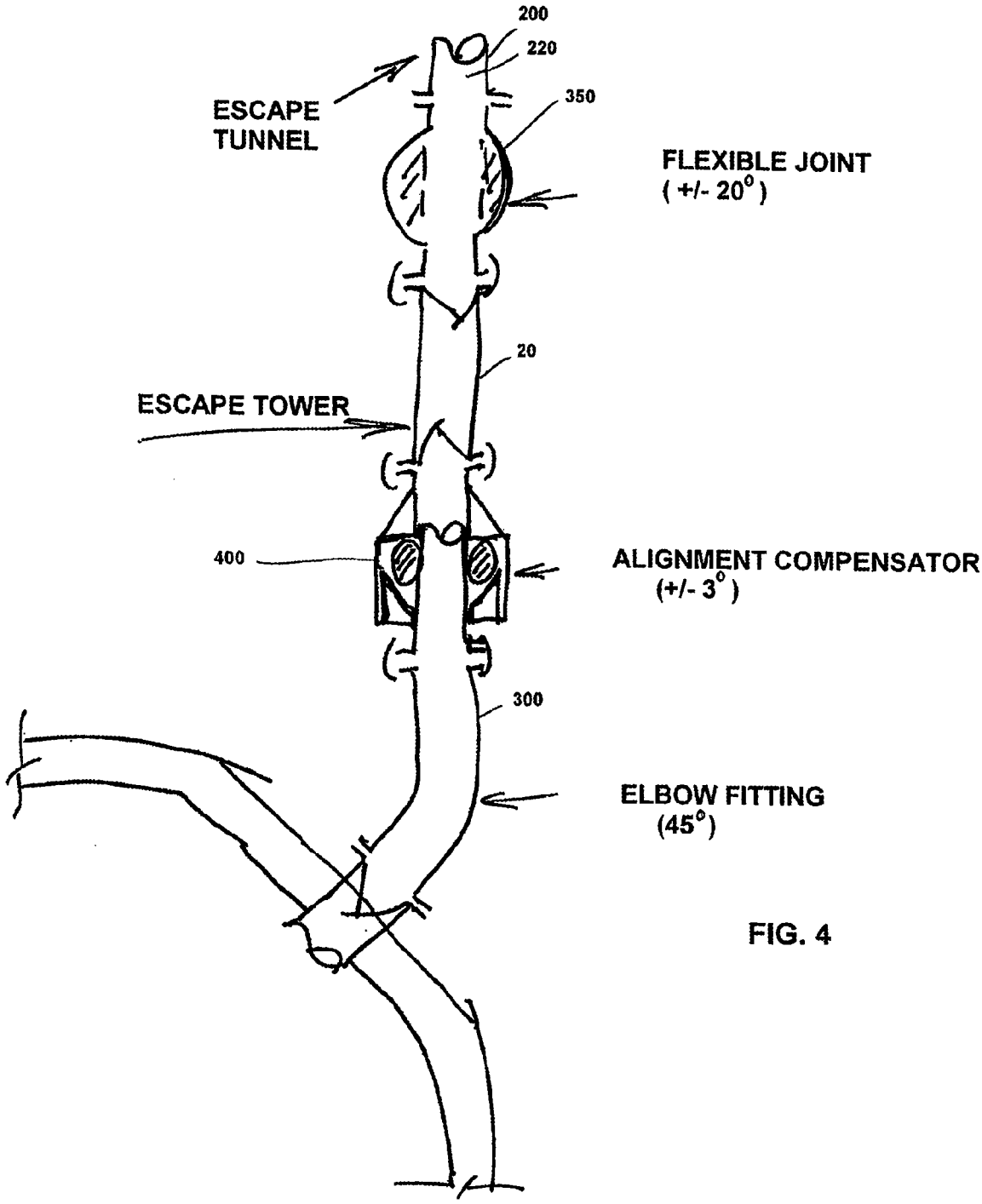
FIG. 4 is another embodiment of a system for allowing escape from a submarine, which includes an elbow fitting, an alignment compensator, an escape tower, a flexible joint, and an escape tunnel connected to one another in series.

Once escape tower 20 has been attached to an appropriately angled elbow fitting 300, the attaching or landing of riser tube 205 requires vertical positioning of riser tube 205 relative to escape tower 20, elbow fitting 300, or previous riser tube 205. In the event that elbow fitting 300 alignment is not adequately angled, e.g., not perpendicular to a water-air interface, a tunnel alignment compensator 400 may be connected between elbow fitting 300 and escape tower 20 as depicted in FIG. 4. Tunnel alignment compensator 400 may be a blow-out preventer, as known in the petroleum drilling art. Such a blow-out preventer may be a hydraulically energized, short rubber cylinder that seals fluid pressure in an annulus between two tubes (e.g., escape tower 20 and elbow fitting 300). Blow-out preventers of large size are known as diverters in the petroleum drilling art, in that they contain specific well-bore pressure, say 2000 psi, and vent excess pressure to a controlled environment. Such a blow-out diverter (i.e., alignment compensator 400) may have a 45 DEG angled lower skirt to guide a bottom end of such blow-out diverter over a quasi-vertical (e.g., an angle of 15–25 DEG from the vertical) leg of the elbow fitting 300. The lengthened leg of the fitting not only acts as a pilot to guide the two components together, but also allows minimal flexure to accommodate forced assembly to overcome minimal misalignment. Also, alignment compensator 400 may be attached to riser tube 205, tower 20, and/or flexible joint 350 prior to such components being lowered toward submarine 50. Alternatively, alignment compensator 400 may be lowered separately from such components and attached to a preceding component, i.e., a component which has been previously attached to submarine 50, e.g., elbow fitting 300, tower 20, riser tube 205, or flexible joint 350, using a drill string or ROV.

Also, if upper connector 310 of elbow fitting 300 cannot be connected to LETC 30 of escape tower 20 due to misalignment, tunnel alignment compensator 400 may allow lower escape tower connector 30 to slide over upper elbow connector 310 of elbow fitting 300 to make a separate seal. Thus, tunnel alignment compensator 400 may provide a separate, redundant sealing mechanism to allow various components to be connected to each other including escape tower 20, riser tube 205, flexible joint 350, and/or elbow fitting 305. For example, alignment compensator 400 may connect to such components at angles up to 25° from the vertical without requiring a relatively long flexible leg. As described, alignment compensator 400 may be guided over an outside vertical leg and may maintain pressure integrity at a more severe angle than a tunnel-pin connector, as depicted for example in FIG. 6.

Figure 5:
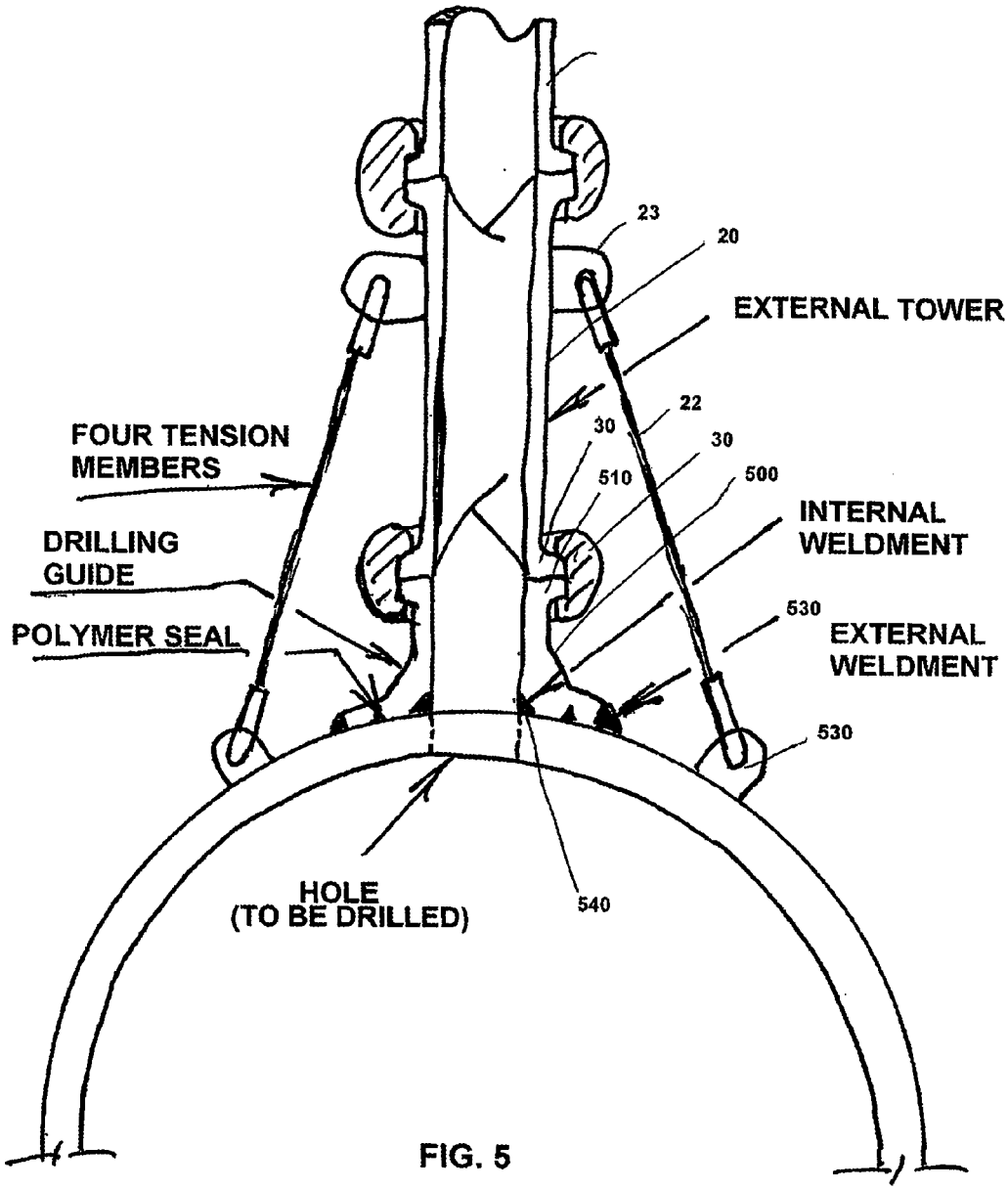
FIG. 5 is yet another embodiment of a system for allowing escape from a submarine which includes a hatch assembly connected to the submarine, along with an escape tower connected to the hatch assembly.

In another example, a submarine may be disabled on a seabed such that its hatches and/or connectors (e.g., hatch 120 and hatch connector 40) have been damaged and/or are otherwise not operable or configured to be attached to escape tower 30 or elbow fitting 300. Also, a hull pressure of the submarine may have been compromised or the submarine otherwise may require that a new hatch be attached thereto to allow personnel to escape therefrom. As depicted in FIG. 5, a separate hatch assembly 500 having a hull-contour configuration (e.g., having a shape corresponding to an exterior of the submarine) could be lowered to the submerged submarine as described above for the other components (e.g., escape tower 20, elbow fitting 300, or riser tube 205) using a drill string. Hatch 500 may be attached to exterior 55 of submarine 50, for example, by being welded by a hard-suit diver in water up to 1500–2000 feet (457–609 meters) from a water-air interface. More specifically, an external strength weld 520 connecting hatch 500 to submarine 50 around the circumference of hatch 500 would be made by the diver. Escape tower 20 could then be connected to a hatch connector 510 as described above for a connection of escape tower 20 to hatch connector 40. Further, hull weld lugs 530 may be welded to exterior 55 of submarine 50. Escape tower 20 may include cables 22 connected to lugs 23 of escape tower 20 and opposite ends of cables 22 may be connectable to weld lugs 530 to strengthen escape tower 20 against bending forces with the cables fastened to hull weld lugs 530 by a diver or Remotely Operated Vehicle (ROV). Escape tunnel 200 including a plurality of riser tubes 205 may be connected in series to escape tower 20 and evacuated of water to provide a path for personnel to descend to perform an interior weld 540 on hatch assembly 500 to exterior 55. Such interior weld may further strengthen the connection and seal between exterior 55 and hatch assembly 500. Welding gases from such an operation may be captured and discharged to the sea to inhibit dangers to such personnel. After such operation, escape tunnel 200 and escape tower 30 may be removed from hatch assembly 500 by utilizing the drill string, as described above.

Hatch assembly 500 may be a drilling guide formed to allow drilling in a tunnel interior 220 through the wall of the submarine utilizing a conventional rotary diamond bit, or extreme-pressure, fluid-jet bit, as are known in the art of petroleum drilling. Such drilling guide (i.e., hatch assembly 500) may be a cylindrical guide to initiate and maintain a surface-normal drilling posture. The diamond bit would be rotated with the drill string as is conventional in petroleum drilling. An extreme-pressure, fluid-jet bit would also be surface rotated but internal fluid would also drive a pressure intensifier within the bit that increases the drill string fluid pressure from about 20,000 psi to 50,000 psi. Either bit would require less than a day to drill through the HSLA hull of the submarine. Neither method would create flame or toxic hazard. Also, the diamond bit could be used for most of the penetration, followed by the fluid-jet bit to complete the task. Any drilling fluid introduced into the tunnel interior 220 may be pumped out via a sump pump, via compressed air, or any other means of removing the water prior to the drill bit penetrating the hull of the submarine.

In another example, hatch assembly 500 may be attached to exterior 55 of the submarine 50 via magnetic means instead of the external welding step described above. Also, hatch assembly 500 may include integral, low temperature polymeric seals to allow all welding to be completed internally, by personnel intervention, after the escape tower is attached. For example, hatch assembly 500 may be attached to the hull by magnetic clamps which cause the polymeric seals to seal hatch assembly 500 with the hull. Escape tunnel 200 may then be attached to hatch assembly 500, tunnel tower 220 may evacuated and personnel may descend therethrough to apply an interior weld to hatch assembly 500. In this example, bending supports with external compression members attached to the hull, instead of tension cables affixed by divers or ROV may be utilized. Such external compression members may be attached between a top portion of hatch assembly 500 (or a portion of escape tower 20) and a hull-contouring plate attached to hatch assembly 500 prior to hatch assembly 500 being lowered toward submarine 50. The use of a ROV would allow extended depth, beyond the depth at which a diver could weld using a hard diving suit, thereby extending the potential application up to about 10,000 feet (3048 meters) below a water-air interface.

After the drilling of a hole in the submarine, the drilling equipment may be removed from escape tunnel 200 (e.g., a plurality of riser tubes) to allow personnel to descend to the submarine and/or to ascend to the water-air interface therethrough using a harness and winch or other means.

Further, the potential depth for intervention to aid a disabled submarine could be extended, i.e. beyond about 10,000 feet (3048 meters), by utilizing thicker walled materials for the various components, e.g., escape tower 20, elbow fitting 300, riser tube 205, but the trade-off becomes heavier components requiring larger drilling vessels to transport the larger quantity of riser tube pipe, made even larger with buoyancy/insulation material.

It will be understood by one skilled in the art that lower escape tower connector 30 may be identical to bottom elbow connector 305 and lower tunnel connector 210. Also, hatch connector 40 may be identical to upper elbow connector 310, upper tunnel connector 230, upper escape tower connector 100, and hatch connector 510. The difference between such respective connectors may be their locations on different components as described above. Further, it will be understood by one skilled the art that the connections between the components described could utilize any connectors which are structurally sound to perform the functions described above, and which exclude water from the interior of such components. It will also will be understood by those skilled the art that the various components, e.g., riser tube 205, escape tunnel 200, escape tower 20, elbow fitting 300, flexible joint 350, and alignment compensator 400, may be connected to one another in different configurations than described above including different orders of connections. For example, escape tunnel 200 could be connected directly to hatch connector 40 without having escape tower 20 therebetween. Such components may also be attached to one another through various latches, locks, or other connectors by remote operation under a sea surface or prior to such components being lowered toward a disabled submarine. In another example such components may be attached to each other by a ROV. Further, it will be understood by one skilled in the art that the welding operations described above may be performed by various remote welding means.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A system for allowing underwater escape from a submarine comprising:

a plurality of walls forming an escape tower having an interior configured to receive at least one person, said plurality of walls configured to resist collapse due to a force of external water, said plurality of walls separating said interior from an exterior of the system, a lower escape tower connector located at a bottom end of said plurality of walls, said lower escape tower connector configured to sealingly attach to a hatch connector of a submerged submarine;

a lower hatch loaded at said bottom end, said hatch allowing a person to pass therethrough;

means for providing air to said interior;

means for selectively maintaining said interior substantially free of the water;

an upper hatch formed in said plurality of walls, said upper hatch being selectively openable to allow the person to pass between said interior and an exterior of said plurality of walls through the upper hatch; and an upper escape tower connector located on said plurality of walls, said upper escape tower connector configured to sealingly connect to a lower escape tunnel connector of an escape tunnel to allow the person to pass from the interior to a tunnel interior of the escape tunnel.

2. The system of claim 1 further comprising an escape tunnel connected to an upper end of said escape tower plurality of walls, said tunnel comprising a lower tunnel connector configured sealingly connected to said escape tower plurality of walls.

3. The system of claim 2 connector located at an upper end of said plurality of walls, wherein said upper escape tower connector is sealingly connected to a lower escape tunnel connector of said escape tunnel.

4. The system of claim 3 wherein said tunnel is configured to allow a person to pass therethrough from said interior of said tower to an air-water interface at a top of a water column above the submarine.

5. The system of claim 3 wherein said tunnel comprises a plurality of riser tubes connected to each other.

6. The system of claim 5 further comprising an alignment-compensator connected to two of said plurality of riser tubes.

7. The system of claim 6 wherein the alignment-compensator comprises a blowout diverter.

8. The system of claim 5 further comprising a flexible joint connected to two of said plurality of riser tubes.

9. The system of claim 1 wherein said walls comprise high strength, low alloy steel.

10. The system of claim 1 wherein said hatch connector comprises a submerged wellhead connector and said lower escape tower connector is configured to sealingly connect to said submerged wellhead connector.

11. A method for allowing underwater escape from a submarine, the method comprising:

attaching a lower escape tower connector of an escape tower to a escape hatch connector of a submerged submarine to sealingly attach a lower end of the escape tower to the submarine;

replacing water in an interior of the escape tower with air;

opening an exterior hatch of the submarine and passing a person through the hatch into the interior;

discharging air from the interior of the escape tower;

opening a hatch of the escape tower;

ascending the person to a water surface utilizing an escape hood.

12. The method of claim 11 wherein the attaching the lower escape tower connector to the hatch connector of the submerged submarine comprises remotely attaching the lower escape tower connector utilizing a drill string.

13. The method of claim 11 wherein the replacing the water in an interior of the escape tower comprises remotely providing air to the interior utilizing a drill string.

14. The method of claim 11 wherein the lower escape tower connector comprises a connector configured to connect a drilling riser tube to a submerged wellhead connector and wherein the e hatch connector of the submerged submarine comprises a submerged wellhead connector.

15. The method of claim 11 wherein the interior of the escape tower is configured to allow a person to be received therein and to pass therethrough.

16. A method for allowing underwater escape from a submarine, the method comprising:

attaching a lower escape tower connector of an escape tower to a hatch connector of a submerged submarine to sealingly attach a lower end of the escape tower to the submarine;

attaching a first riser tube to an upper escape tower connector of the escape tower;

forming an escape tunnel by attaching a second riser tube to the first riser tube;

replacing water in an interior of the escape tower and a tunnel interior of the escape tunnel with air;

opening an exterior hatch of the submarine and passing a person through the hatch;

raising the person to water's surface through the tunnel.

17. The method of claim 16 wherein the first riser tube and the second riser tube comprise drilling riser tubes configured for use in drilling undersea petroleum wells.

18. The method of claim 16 wherein the raising comprises the person being received in a harness and the person being raised to the surface by a winch connected to the harness by a cable.

19. The method of claim 16 further comprising attaching an elbow fitting between the hatch connector and the escape tower.

20. The method of claim 19 wherein the elbow fitting comprises a lower elbow connector and an upper elbow connector and further comprising connecting the lower elbow connector to the hatch connector and the upper elbow fitting to the upper escape tower connector.

21. The method of claim 16 wherein the attaching the lower escape tower connector to the hatch connector comprises remotely attaching the lower escape tower connector utilizing a drill string.

22. The method of claim 16 wherein the replacing the water in an interior of the escape tower comprises remotely providing air to the interior utilizing a drill string.

23. The method of claim 16 wherein the hatch connector comprises a submerged wellhead connector and wherein the lower escape tower connector comprises a lower escape tunnel connector configured to connect a drilling riser tube to the submerged wellhead connector.

24. The method of claim 16 wherein the first riser tube and the second riser tube comprise riser tubes of a plurality of riser tubes of the tunnel and further comprising attaching an alignment-compensator between two riser tubes of the plurality of riser tubes of the tunnel utilizing a drill string.

25. The method of claim 24 wherein the alignment-compensator comprises a blowout diverter.

26. The method of claim 16 wherein the first riser tube and the second riser tube comprise riser tubes of a plurality of riser tubes of the tunnel and further comprising attaching a flexible joint between two riser tubes of the plurality of riser tubes of the tunnel utilizing a drill string.

27. The method of claim 16 further comprising attaching the hatch connector of the submarine to the submarine by attaching a hatch assembly to the submarine.

28. The method of claim 27 further comprising drilling a hole in the submarine to allow a person to pass through the hole and through the hatch assembly into at least one of the interior the escape tower and an escape tunnel.

29. A method for allowing underwater escape from a submarine, the method comprising:

attaching a hatch assembly to the exterior of the submarine when the submarine is submerged;

attaching an escape tower to a connector of the hatch assembly;

attaching an escape tunnel to the escape tower;

sealing the hatch assembly relative to the exterior of the submarine;

attaching a drilling guide to the escape tower; and drilling a hole in a wall of the submarine through the drilling guide.

30. The method of claim 29 further comprising attaching hull weld lugs to the exterior of the submarine.

31. The method of claim 30 further comprising attaching an escape tower to the weld lugs via a cable.

32. The method of claim 29 wherein the sealing comprises sealing the hatch assembly to the submarine by welding an interior weld on an interior surface of the hatch assembly.

33. The method of claim 29 wherein the hatch assembly further comprises a low temperature seal for sealing the hatch assembly relative to the exterior.

34. A system for allowing underwater escape from a submarine comprising:

a plurality of walls forming an interior configured to receive at least one person, said plurality of walls configured to resist collapse due to a force of external water, said plurality of walls separating said interior from an exterior of the system;

a lower escape tower connector located at a bottom end of said plurality of walls, said lower escape tower connector configured to sealingly attach to a hatch connector of a submerged submarine;

a lower hatch located at said bottom end, said lower hatch allowing a person to pass therethrough;

means for providing air to said interior;

means for selectively maintaining said interior substantially free of the water;

means for selectively substituting the water for the air in said interior when the system is submerged underwater, and said lower escape tower connector is attached to the hatch connector;

an upper hatch formed in said plurality of walls, said upper hatch being selectively openable to allow the person to pass between said interior and an exterior of said plurality of walls through the upper hatch.

* * * * *

UNITED STATES PATENT AND TRADEMARK OFFICE

CERTIFICATE OF CORRECTION

PATENT NO. : 6,925,954 B1
DATED : August 9, 2005
INVENTOR(S) : Van Acker, Jr. et al.

It is certified that error appears in the above-identified patent and that said Letters Patent is hereby corrected as shown below:

Column 10,
Line 33, delete the words “escape tower”.
Lines 35 and 36, delete the words “configured” and “escape tower”.
Lines 37 and 38, delete the words “connector located at an upper end of said plurality of walls,”.

Signed and Sealed this

First Day of November, 2005

JON W. DUDAS
*Director of the United States Patent and Trademark Office*